United States Patent [19]

Macmillan et al.

[11] Patent Number: 4,723,379

[45] Date of Patent: Feb. 9, 1988

[54] ABRASIVE THROWING WHEEL

[75] Inventors: William R. Macmillan; James M. Smith, both of Greater Manchester, United Kingdom

[73] Assignee: Tilghman Wheelabrator Limited, United Kingdom

[21] Appl. No.: 861,105

[22] Filed: May 6, 1986

Related U.S. Application Data

[63] Continuation of Ser. No. 599,733, Apr. 12, 1984, abandoned.

[30] Foreign Application Priority Data

Feb. 3, 1983 [GB] United Kingdom ..... 8332348

[51] Int. Cl.[4] ..... B24C 5/06

[52] U.S. Cl. ..... 51/434; 51/432

[58] Field of Search ..... 51/435, 434, 433, 432, 51/412, 410, 431

[56] References Cited

U.S. PATENT DOCUMENTS

| | | | |
|---|---|---|---|
| 2,355,726 | 8/1944 | Harder | 51/435 |
| 2,869,289 | 1/1959 | Gossard | 51/435 |
| 3,034,262 | 5/1962 | Pawlson | 51/433 |
| 3,160,990 | 12/1964 | Bowling, Jr. | 51/432 |
| 3,401,489 | 9/1968 | Wern | 51/424 |
| 3,491,563 | 1/1970 | Alonso | 51/433 |
| 3,694,963 | 10/1972 | Laliaert | 51/435 |
| 3,848,815 | 11/1974 | Carpenter, Jr. et al. | 51/433 |
| 4,062,155 | 12/1977 | Fricke | 51/433 |
| 4,244,150 | 1/1981 | Goff | 51/434 |
| 4,333,278 | 6/1982 | Schulte et al. | 51/434 |
| 4,447,993 | 5/1984 | Laido | 51/435 |

FOREIGN PATENT DOCUMENTS

| | | | |
|---|---|---|---|
| 2538228 | 3/1977 | Fed. Rep. of Germany | 51/432 |
| 1551281 | 8/1979 | United Kingdom . | |

*Primary Examiner*—Frederick R. Schmidt
*Assistant Examiner*—Robert A. Rose
*Attorney, Agent, or Firm*—Jones, Day, Reavis & Pogue

[57] ABSTRACT

An abrasive throwing wheel comprises a backplate, a plurality of equi-angularly spaced radially-extending, throwing or paddle blades and a central impellor, all formed as an integral unit, and with the blades configured to render the throwing wheel operationally bi-directional. The throwing wheel may be cast from "hard" metal generally a high chrome content alloy; or it may comprise a metallic core with a plastics coating (preferably an elastomeric polyurethane coating) moulded therearound; or it may be formed wholly of plastics, preferably an elastomeric polyurethane coating.

5 Claims, 13 Drawing Figures

21
20
21
20
23

IX
XII
23B
23
25
26
22
X
XI
XI
24
20
21
24A
23
24C
24B
25
31
24C
24D
24D
X
24A
20
21
23A
23
21
23A
IX
21

23
R2
R1
22

27
26
31
27
22

ABRASIVE THROWING WHEEL

This application is a continuation of application Ser. No. 599,733, filed Apr. 12, 1984, now abandoned.

This invention relates to an abrasive throwing wheel for use in shot blasting machinery.

It is an object of the present invention to provide such a throwing wheel which is cheaper and simpler to manufacture than existing throwing wheels and which requires less power to drive than an equivalent sized existing throwing wheel operating under the same conditions.

According to the present invention there is provided an abrasive throwing wheel comprising a back plate, a plurality of equi-angularly spaced radially-extending, throwing or paddle blades and a central impellor, all formed as an integral unit, and with the blades configured to render the throwing wheel operationally bi-directional.

The throwing wheel may be cast from "hard" metal, a term well-known to those skilled in the shot blasting art, and generally a high chrome content alloy.

The throwing wheel may also comprise a metallic core with a plastics coating moulded therearound.

The metallic core may comprise the back plate and the throwing or paddle blades. Preferably, however, the metallic core also includes the central impellor.

The metallic core is preferably a fabricated steel plate core. It may alternatively be cast in hard metal.

The plastics coating is preferably an elastomeric polyurethane coating, preferably molecular bonded.

The elastomeric polyurethane preferably has a hardness within the range of A50 Shore to D50 Shore on the IRHD (International Rubber Hardness Degree) scale.

The throwing wheel may be formed wholly of elastomeric polyurethane having a hardness within the aforesaid range on the IRHD scale.

The hardness factor of the elastomeric polyurethane employed will depend, inter alia, to the duty to which the throwing wheel is subjected, to the kind and/or size of abrasive employed, to its operational environment and the centrifugal forces to which it is subjected.

Preferably, the impellor comprises equi-angularly spaced vanes defining a tapered inlet for the abrasive to the wheel. The impellor vanes, preferably, define an inwardly reducing tapered abrasive receptacle. Such tapering serves to assist uniform distribution of the abrasive to the throwing blades or paddles by directing the abrasive back from the backplate or inner end of the impellor towards the inlet thereof and so out through the inter-vane spaces to the blades.

The impellor preferably comprises an outwardly-directed central conical formation which serves to assist return of the abrasive towards the impellor inlet and so the aforesaid uniform distribution of the abrasive.

Preferably, the junction line between each blade side and the backplate is radiussed, which radius increases from the inner, impellor-adjacent end of the blade to the tip of the latter. This increasing radius assists spread of the abrasive across the throwing face of the blade and consequently improves uniformity of wear of the blade.

Preferably, each blade increases in thickness from its inner impellor-adjacent end to its tip which thus reduces the overall weight of the throwing wheel while presenting more metal at the area of the blade where greatest wear by the abrasive tends to occur.

The blades also taper across the width of their faces and this together with the lengthwise taper assists in inducing spread of abrasive across the blade thus obviating straight-line grooving which is a customary wear pattern in such throwing blades or paddles.

The backplate between throwing blade or paddle regions may be chordally cut-away or of reduced diameter to reduce weight.

Preferably, the backplate on its face opposite to that with which the throwing blades or paddles are integral is cast with a plurality of equi-angularly spaced bosses into which bolt-receiving steel inserts are cast, these inserts being adapted to receive bolts securing a drive hub to the throwing wheel.

These bosses and corresponding inserts can, during manufacture of the throwing wheel, be cast in different radial spacings from the throwing wheel centre to suit the particular hub configuration to which the throwing wheel is to be secured.

The steel inserts which stand proud of the bosses have a diameter machined in them for hub location. Thus, no machining of the hard metal bosses or backplate is necessary.

Instead of steel inserts the bosses or the backplate per se, i.e. no bosses provided, may have screwthreads cast therein where the backplate is of hard metal.

Where the backplate is of steel plate it may be tapped to receive the hub securing bolts.

An annular steel boss drilled and tapped at appropriate angular locations to receive hub securing bolts may be fitted or cast into the backplate.

Preferably, a control cage is provided to surround the impellor as is customary, the control cage being of differential diameter at its abrasive entry end to provide an internal annular locating seat for a feed spout spaced outwardly of the impellor inlet relative to the backplate.

Where the throwing wheel is a plastics, metal-cored throwing wheel the control cage is preferably formed wholly of plastics material. The latter is preferably a polyurethane which may be molecular bonded.

The elastomeric polyurethane constituting the control cage preferably has a hardness greater than that forming the coating around the metal core of the throwing wheel.

Embodiments of the present invention will now be described, by way of example, with reference to the accompanying drawings, in which.

Figure 2:
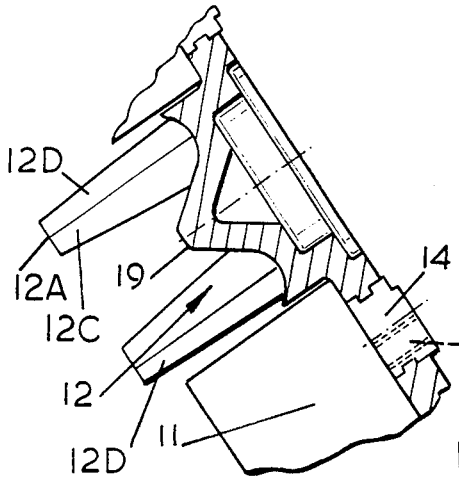
FIG. 2 is a fragmentary sectional view on the line II—II of FIG. 1.

Referring to FIGS. 1 to 7, the abrasive throwing wheel is cast in one-piece from "hard" metal (for example a high chrome content alloy).

The throwing wheel comprises a single circular backplate 10 having integral throwing blades 11 and an integral central impellor 12.

The backplate 10 also has on its rear face four integral radial bosses 13 into each of which is cast a bolt receiving insert 14 formed with a tapped hole 15. The inserts 14 are made of steel, and a diameter D is machined in these inserts for hub location. This diameter D is determined by the hub configuration to which the throwing wheel is to be bolted.

Figure 6:
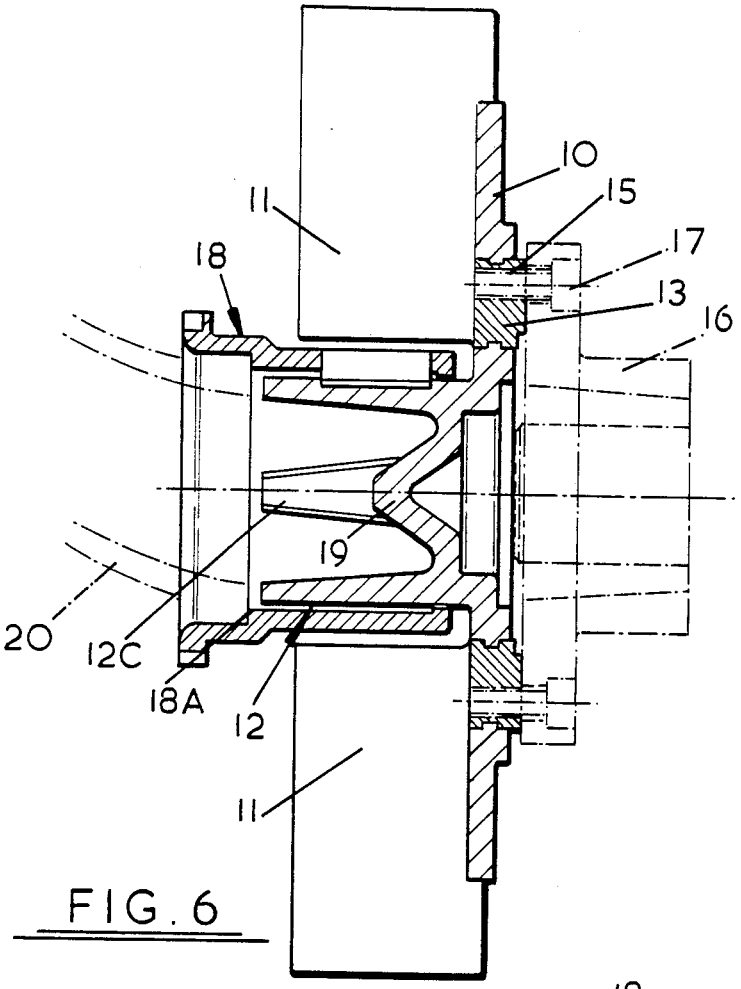
FIG. 6 is a diametrical sectional view of the throwing wheel of FIG. 1 with a control cage fitted thereon and a hub and feed spout indicated in dot dash lines.
Figure 7:
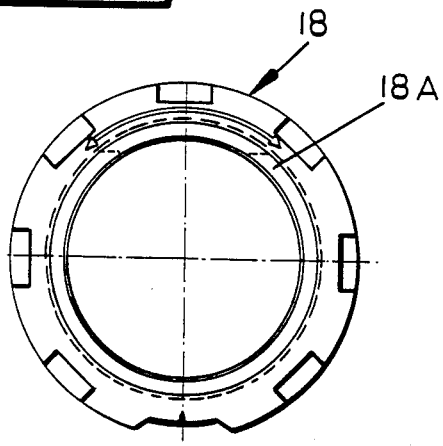
FIG. 7 is a front view of the control cage.

It is to be noted that in FIG. 6 the angular position of the inserts 13 is shown incorrectly merely for the purpose of showing as much detail of the inserts 13 as possible.

In FIG. 6 is can be seen that the throwing wheel is secured to a driving hub 16 by bolts 17 which screw-engage the tapped holes 15.

Figure 1:
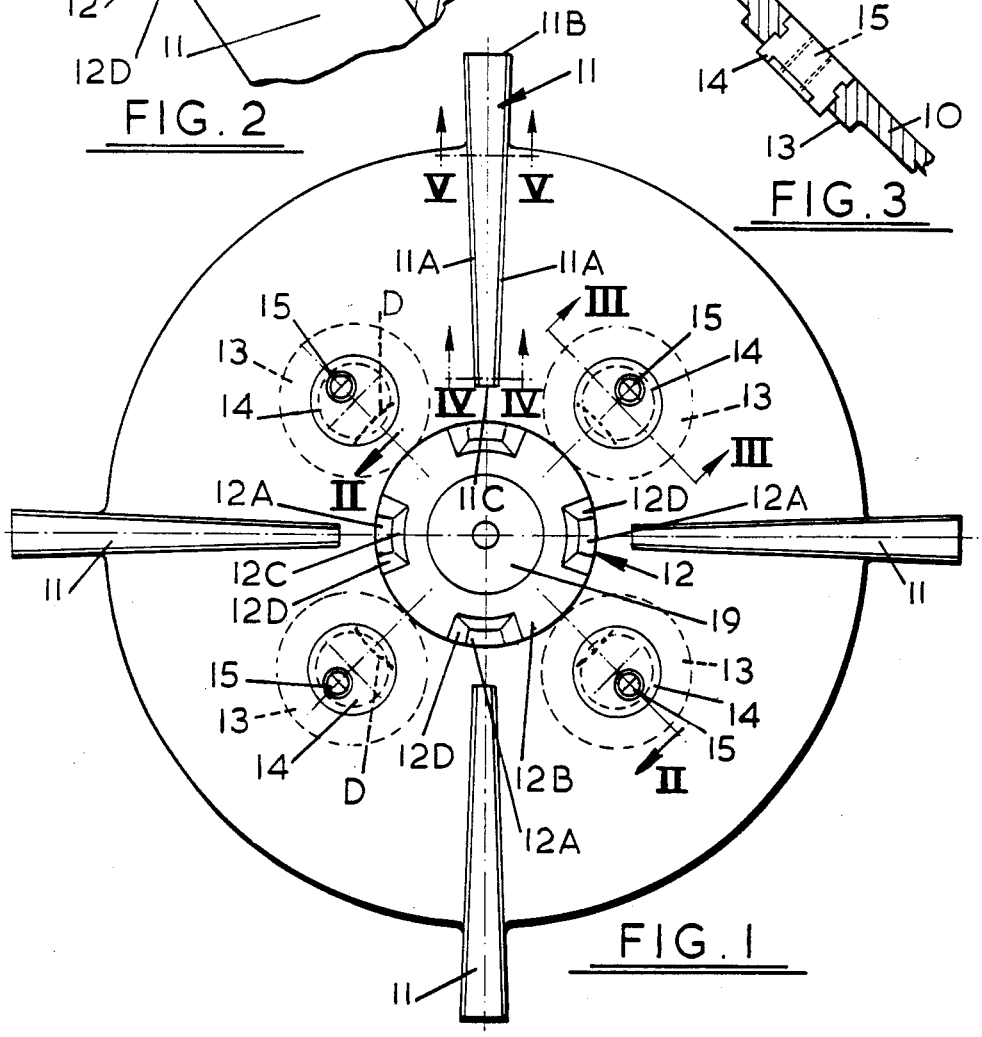
FIG. 1 is a front view of an abrasive throwing wheel according to the invention.

The throwing wheel of this embodiment has four throwing blades or paddles 11 spaced 90° apart and it will be seen from FIG. 1 in particular that each throwing face 11A is identical which means that the throwing wheel is operationally bi-directional.

Each blade or paddle 11 is thicker at its tip 11B than at its inner end 11C. In fact, it is double the thickness at its tip 11B than it is at its inner end. The blade 11 thus has a greater amount of metal in the area where greatest abrasive wear occurs, say the outer half of the blade, but also allows the overall weight of the throwing wheel to be reduced by permitting thinning of the blade over the inner half, say.

Figure 5:
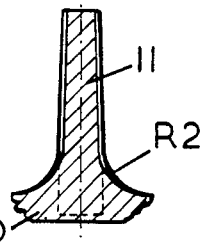
FIGS. 4 and 5 are respectively sectional views of one of the blades on the lines IV—IV and V—V of FIG. 1.
Figure 4:
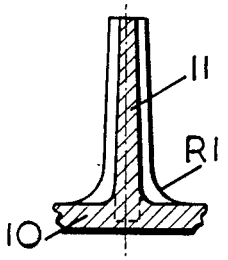
Figure 3:
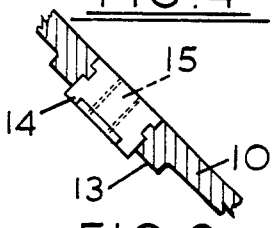
FIG. 3 is a fragmentary sectional view on the line III—III of FIG. 1.

Each blade 11 also tapers across the width of its face as can be seen best from FIGS. 1, 4 and 5.

Each blade 11 where it joins the backplate 10 is radiussed and this radius R1 gradually increases from the inner end 11C to radius R2 at the tip 11B.

This increasing radius and the lengthwise and widthwise tapering of the blade assists flow of the abrasive across the width of the throwing face of the blade which serves to assist uniformity of wear of the blade by the action of the abrasive and to avoid straight line groove wear.

The impellor 12 is centrally of the backplate 10 and a pitch circle defined by the inner ends 11B of the blades 11.

The impellor 12 is disposed radially inwardly of the blade inner ends 11B to permit location of a control cage 18 therebetween (see FIG. 6).

The impellor 12 comprises four equi-angularly spaced vanes 12A defining four inter-vane passages 12B for centrifugal egress of abrasive from the impellor 12. The inner faces 12C of the vanes 12 define a mouth which reducingly tapers from the impellor inlet towards the backplate 10.

Centrally of the impellor 12 is a conical formation or boss 19 reducingly tapering from the backplate 10 towards the impellor inlet.

The inner tapering of the impellor vanes 12A and the provision of the conical boss 19 serve to direct the incoming abrasive away from the backplate 10 towards the impellor inlet and so uniformly out of the inter-vane spaces 12B towards the blades 11. These inter-vane spaces 12B are defined by the side faces 12D of adjacent vanes 12A and it is to be noted (see particularly FIG. 1) that these spaces are wider at the impellor inlet than at the backplate 10. This outward widening of the inter-vane spaces 12B assists uniform centrifugual egress of abrasive out of the impellor 12 outwardly of the backplate 10.

The control cage 18 is of the generally known construction and is dual handed. It is inwardly stepped as indicated at 18A to provide an annular seat spaced from the mouth of the impellor 12 to locate the outlet end of an abrasive feed spout 20.

It is to be noted that in manufacturing an abrasive throwing wheel as described above, the wheel can be used as its own core, that is each side or face of the wheel is simply pressed into the moulding sand without the need to provide any ancillary core elements. Manifestly this makes the manufacture of this throwing wheel easier and cheaper than existing throwing wheels.

Reference is now made to FIGS. 8 to 13 which again is of one piece construction and which has all the characteristic construction features of the throwing wheel of FIGS. 1 to 7.

This throwing wheel may be formed wholly of elastomeric polyurethane but, in this instance, is constituted by a metal core 20 preferably of fabricated steel plate covered by an elastomeric molecular bonded polyurethane coating 21, the elastomeric polyurethane having a harness within the range A50 Shore to D50 Shore of the IRHD scale.

More specifically, the backplate 22, the throwing blades or paddles 23 and the central impellor 24 are all constituted by a unitary fabricated steel plate core wholly covered with an elastomeric coating having a hardness within the range A50 Shore to D50 Shore of the IRHD scale.

The elastomeric polyurethane coating 21 is moulded (injection or compression moulding for example) around the metal core 20.

The backplate 22 in this instance is chordally cutaway as indicated at 25 between throwing blades or paddles 23 to assist in weight reduction.

As aforesaid, the characteristic constructional features of the cast, hard metal, throwing wheel of FIGS. 1 to 7 are all to be found in the metal-cored elastomeric polyurethane throwing wheel of FIGS. 8 to 13 but for the avoidance of doubt, the latter will now be described in more detail.

The backplate 22 has on its rear face an annular steel boss 26 which is drilled and tapped as indicated at 27 to receive hub securing bolts 28.

Figure 13:
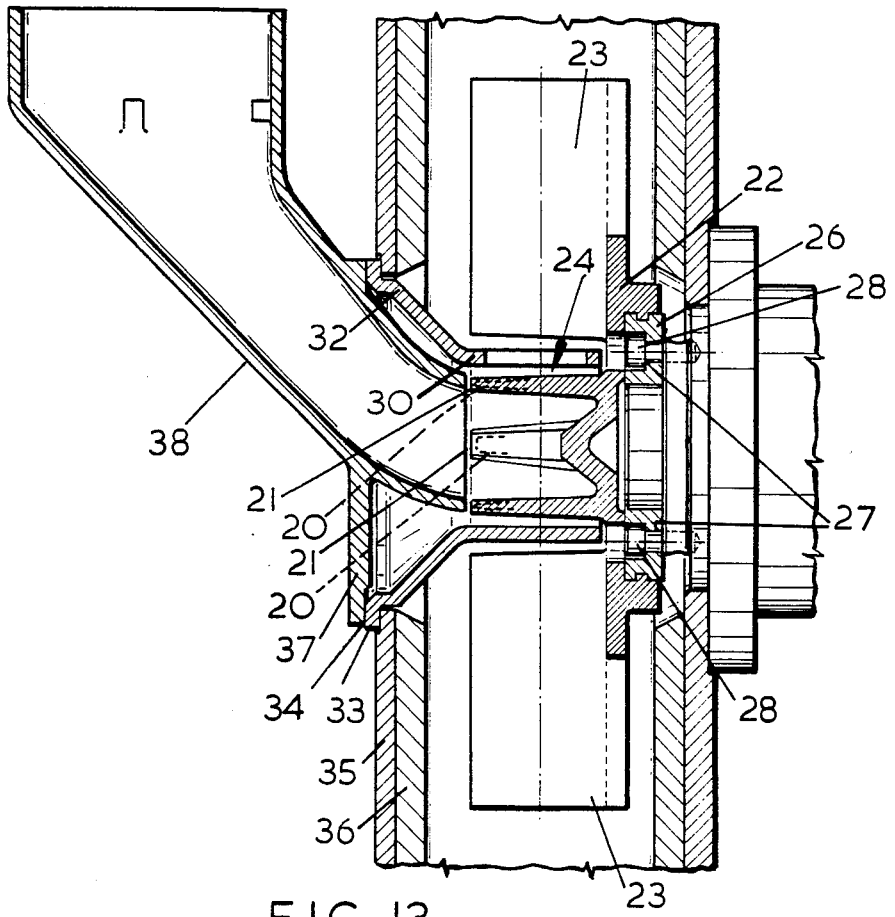
FIG. 13 is a fragmentary sectional view of the throwing wheel of FIG. 8 with associated control cage, feed spout and hood assembly.

In FIG. 13 it can be seen that the throwing wheel is secured to a driving hub 28 by the bolts 28 which screw-engage in the tapped holes 27.

Figures 8, 10, 11, 12:
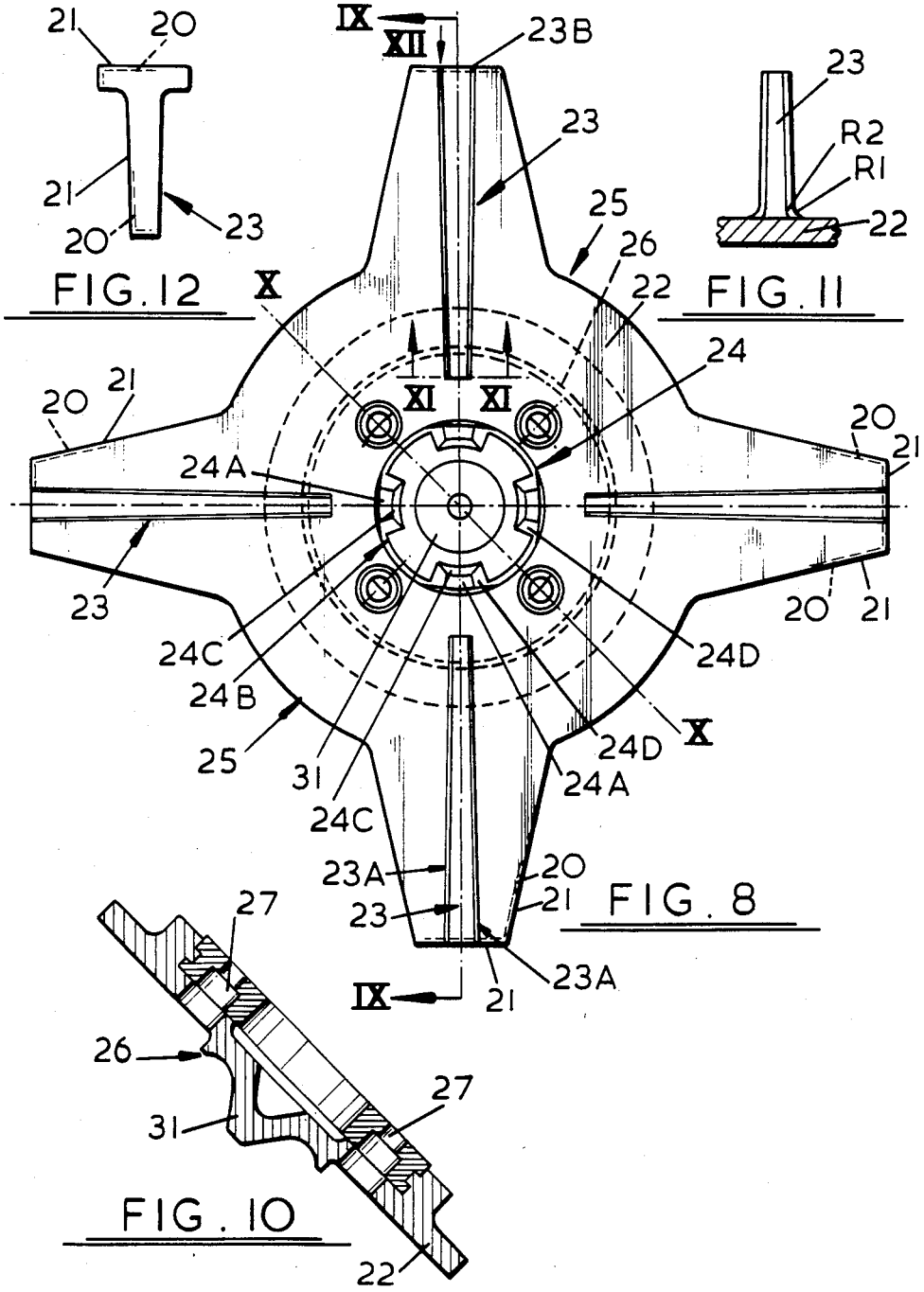
FIG. 8 is a front view of a plastics covered, metal-cored throwing wheel according to the invention.
FIG. 10 is a section along the line X—X of FIG. 8.
FIG. 11 is a section along the line XI—XI of FIG. 8.
FIG. 12 is a view in the direction of arrow XII of FIG. 8.
Figure 9:
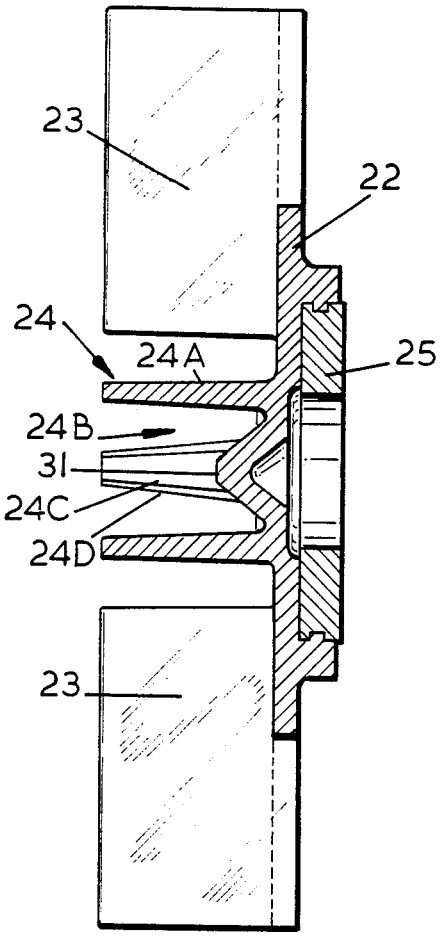
FIG. 9 is a section along the line IX—IX of FIG. 8.

The throwing wheel of this embodiment has four throwing blades or paddles 23 spaced 90° apart and it will be seen from FIG. 8 in particular that each throwing face 23A is identical which means that the throwing wheel is operationally bi-directional.

Each blade or paddle 23 is thicker at its tip 23B than at its inner end 23C. In fact, it is double the thickness at its tip 23B than it is at its inner end. The blade 23 thus has a greater amount of metal in the area where greatest abrasive wear occurs, say the outer half of the blade, but also allows the overall weight of the throwing wheel to be reduced by permitting thinning of the blade over the inner half, say.

Each blade 23 also tapers across the width of its face as can be seen best from FIGS. 8, 11 and 12.

Each blade 23 where it joins the backplate 22 is radiussed and this radius R1 gradually increases from the inner end 23C to radius R2 at the tip 23B.

This increasing radius and the lengthwise and widthwise tapering of the blade assists flow of the abrasive across the width of the throwing face of the blade which serves to assist uniformity of wear of the blade by the action of the abrasive and to avoid straight line groove wear.

The impellor 24 is centrally of the backplate 22 and a pitch circle defined by the inner ends 23B of the blades 23.

The impellor 24 is disposed radially inwardly of the blade inner ends 23B to permit location of a control cage 26 therebetween (see FIG. 13).

The control cage 30, in this embodiment, is formed wholly of elastomeric polyurethane of a hardness within the A50 Shore to D50 Shore range but with a greater hardness value than the aforesaid elastomeric polyurethane coating 21. This is considered necessary since the control cage 26 does not have a reinforcing metallic core and due to centrifugual forces may lose its physical stability and/or configuration.

The impellor 24 comprises four equi-angularly spaced vanes 24A defining four inter-vane passages 24B for centrifugal egress of abrasive from the impellor 24. The inner faces 24C of the vanes 24 define a mouth which reducingly tapers from the impellor inlet towards the backplate 22.

Centrally of the impellor 24 is a conical formation or boss 31 reducingly tapering from the backplate 22 towards the impellor inlet.

The inner tapering of the impellor vanes 24A and the provision of the conical boss 31 serve to direct the incoming abrasive away from the backplate 22 towards the impellor inlet and so uniformly out of the inter-vane spaces 24B towards the blades 23. These inter-vane spaces 24B are defined by the side faces 24D of adjacent vanes 24A and it is to be noted (see particularly FIG. 8) that these spaces are wider at the impellor inlet than at the backplate 22. This outward widening of the inter-vane spaces 24B assists uniform centrifugal egress of abrasive out of the impellor 24 outwardly of the backplate 22.

The control cage 30 is of the generally known construction and is dual handed. It has a flared mouth or inlet 32 with an outwardly-directed flange 33 engagable in a recess 34 in the wall of a hood 35 lined, as is conventional, with wear plates 36.

The flange 33 is clamped in the recess 34 by a flange 37 of an abrasive feed spout 38.

The relative thickness of metal core and elastomeric coating are determined mainly by the particular duty to which the throwing wheel is to be subjected, the abrasive employed, the working environment of the throwing wheel and the centrifugal forces applied to the throwing wheel.

A throwing wheel moulded from elastomeric polyurethane with or without a metal core can conveniently be used in applications where the use of a conventional all-metal throwing wheel or even an all-metal throwing wheel according to the present invention is not desirable but where until now has been imposed on the user. For example, in the production of airframe components an all-metal wheel is preferably not employed (but has hitherto out of necessity been used) in case, for whatever reason, it broke up since the resulting shrapnel from the disintegrating throwing wheel could do hundreds of thousands of pounds damage. This is less likely with a plastics-coated wheel or an all-plastics throwing wheel.

Moreover, a metal-cored plastics throwing wheel or all-plastics throwing wheel can be employed to throw abrasives not usable with all-metal wheels due to their extremely severe wear characteristics. Such abrasives are well-known to those skilled in the art.

Further, a metal-cored plastics or all-plastics throwing wheel can be used where hitherto air blast abrasive cleaning is usually employed but with far superior results. For example, a selected metal-cored plastics or all-plastics throwing wheel can throw 70 lbs weight of abrasive per minute employing a power factor of 1.5 horsepower while a ½ inch diameter air blast nozzle can only impel 6 lbs weight of abrasive per minute with the power factor necessary to provide the compressed air carrier being 50 horsepower.

Various modifications may be made. For example there could be an odd number of throwing blades or paddles; the bosses need not be equi-angularly spaced; instead of bolts, set screws or studs could be employed to secure the hub to the backplate of the throwing wheel; instead of having bolt-receiving holes, the backplate may have studs welded thereon for hub securement; the throwing blades or paddles need not be twice the thickness at their tips, it is only preferred that they increase in thickness from inner end to tip.

The impellor inlet may be parallel and the impellor may be a flat bottom, i.e. no conical formation. The junction line between each blade and the backplate need not be radiused, or, if radiused, uniformly radiused. The blades need not be lengthwise and/or widthwise tapered. The control cage may be of uniform diameter and is of plastics may be metal cored.

It will be manifest that either of the two embodiments of throwing wheel described above can be (a) cast in hard metal; (b) a fabricated metal (e.g. steel plate) core with an elastomeric polyurethane coating; (c) a cast hard metal core with an elastomeric polyurethane coating; (d) a wholly elastomeric polyurethane wheel.

What is claimed is:

1. A reversible abrasive throwing wheel comprising:
a backplate;
a plurality of throwing blades integrally formed with the backplate, the blades radially-extending with respect to the center of the backplate and joined thereto at a junction having a gradually and uniformly increasing radius of curvature in the radially-outwardly direction with respect to the center of the backplate, the blades having two substantially identical opposing faces and becoming progressively thicker in the radailly-outwardly direction with respect to the center of the backplate, the blades also being progressively tapered axially away from the backplate;
whereby the overall weight of the wheel is reduced due to the progressive thickening of the blade, uniform wear of the blade is assisted and wear lines avoided due to the progressive tapering and radius of curvature change at the blade-backplate junction, and the throwing wheel can be used as its own casting core.

2. The throwing wheel of claim 1, further comprising
a central impellor located radially-inwardly of the blades, the impellor comprising a plurality of vanes defining a tapered inlet for the abrasive to the wheel and an outwardly-directed central conical formation inward of the vanes, whereby abrasive returned from the backplate is directed back toward the inlet and out inter-vane spaces to the blades.

3. The throwing wheel of claim 2 wherein the central impellor is an integral unit with the backplate and blades.

4. The throwing wheel of claim 1 wherein the blade is about twice as thick at its radially-outward end as at its radially-inward end.

5. The throwing wheel of claim 1 wherein the integral backplate and blades are comprised of a metallic core having elastomeric polyurethane coating.

* * * * *